US007033289B2

(12) United States Patent
Sharrocks

(10) Patent No.: US 7,033,289 B2
(45) Date of Patent: Apr. 25, 2006

(54) SOCCER BALL KICKING TRAINING DEVICE

(76) Inventor: Mark P. Sharrocks, 33 Sheffield Rd., East Windsor, NJ (US) 08520

( * ) Notice: Subject to any disclaimer, the term of this patent is extended or adjusted under 35 U.S.C. 154(b) by 0 days.

(21) Appl. No.: 10/870,218

(22) Filed: Jun. 17, 2004

(65) Prior Publication Data

US 2005/0221918 A1 Oct. 6, 2005

Related U.S. Application Data

(60) Provisional application No. 60/559,147, filed on Apr. 2, 2004.

(51) Int. Cl.
*A63B 69/00* (2006.01)

(52) U.S. Cl. ..... 473/446; 473/422

(58) Field of Classification Search ..... 473/422, 473/452, 446, 438, 218
See application file for complete search history.

(56) References Cited

U.S. PATENT DOCUMENTS

| | | | | |
|---|---|---|---|---|
| 2,239,200 | A * | 4/1941 | Peterson | 473/420 |
| 2,316,994 | A * | 4/1943 | Silva | 473/420 |
| 2,458,984 | A | 1/1949 | Engle | |
| 3,300,219 | A * | 1/1967 | Sipos | 473/218 |
| 3,328,030 | A | 6/1967 | Lee et al. | |
| 3,348,842 | A | 10/1967 | Stern | |
| 3,370,851 | A | 2/1968 | Murray | |
| 3,899,179 | A * | 8/1975 | Vlach | 473/218 |
| 4,325,548 | A | 4/1982 | Piccini | |
| 4,538,815 | A * | 9/1985 | Poirier | 473/218 |
| 4,865,330 | A | 9/1989 | D'Amico | |
| 5,076,580 | A * | 12/1991 | Lang | 473/417 |
| 5,280,922 | A | 1/1994 | Jones | |
| 5,290,043 | A | 3/1994 | Vidinic | |
| 5,330,176 | A * | 7/1994 | Cagney, Jr. | 473/452 |
| 5,435,572 | A | 7/1995 | Covel | |
| 5,613,678 | A * | 3/1997 | McKee et al. | 473/397 |
| 5,669,833 | A | 9/1997 | Stone | |
| 5,697,791 | A | 12/1997 | Nashner et al. | |
| 6,220,974 | B1 | 4/2001 | Moore | |
| 6,475,108 | B1 | 11/2002 | Sarenana, Sr. et al. | |
| 2003/0228942 | A1 | 12/2003 | Hsieh | |

* cited by examiner

*Primary Examiner*—Mitra Aryanpour
(74) *Attorney, Agent, or Firm*—Synnestvedt Lechner & Woodbridge LLP

(57) ABSTRACT

A soccer ball kicking training device assists a player so that his or her plant foot are correctly positioned with respect to the target line. A foot positioning pad includes a foot outline indicia and is attached to an adjustable cross member. The other end of the cross member is attached to an offset member which supports a ball positioning pad. An arrow points in the direction of the plant foot towards the target line. The player positions his or her plant foot adjacent to the indicia and adjusts the length of the cross-member so that the member is approximately shoulder width. The foregoing positions the soccer ball slightly behind the plant foot and "squares" the players shoulders so that when the player kicks the ball the ball goes in the line of the arrow and directly towards the target.

7 Claims, 4 Drawing Sheets

SOCCER BALL KICKING TRAINING DEVICE

CROSS REFERENCE TO RELATED APPLICATIONS

This application claims the priority of provisional U.S. application Ser. No. 60/559,147 filed on Apr. 2, 2004 and entitled "Soccer Training Device" by Mark P. Sharrocks, the entire contents and substance of which are hereby incorporated in total by reference.

BACKGROUND OF THE INVENTION

1. Field of the Invention

A soccer ball kicking training device optimally positions the plant foot of the kicker correctly with respect to the strike foot so that the kicker quickly learns the proper way to kick a soccer ball.

2. Description of Related Art

There are a limited number of devices which exist in the prior art to assist an individual in the kicking of an object such as a ball.

Typical of such inventions is the "Foot-Ball Kicking Trainer" described in U.S. Pat. No. 2,316,994 which includes a target or spotter portion which establishes a place to plant the non-kicking foot. A ball rack supports the ball for the kicking foot. The rack can be shifted to the opposite leg of the spotter portion so that the trainer can be used by an opposite kicking leg kicker. In general, the kicking foot is located behind the ball supporting portion making it more appropriate for kicking an object such as a conventional American football.

U.S. Pat. No. 2,239,200 entitled "Device for Training Football Kickers" includes a channel for the kicking foot and a channel for the opposite, or plant, foot.

US Patent Application Publication No. U.S. 2003/0228942 A1, published on Dec. 11, 2003, describes a "Soccer Ball Shooting Practice Device" having a ball supporting section, a plurality of arrows and a methodology for placing the non-kicking, plant foot.

Similarly, a "Soccer Kicking-Training Device" is described and illustrated in U.S. Pat. No. 4,865,330. According to that invention the device apparently has the capability of adjusting the angle/attitude of the kicking foot with respect to the ball to be kicked.

In addition, U.S. Pat. No. 5,435,572, entitled "Ball Kick-Training Device" includes a foot support pad for each of the kicker's feet, that is to say, the plant foot and the kicking, or striking foot.

The following US patents all describe soccer training devices relevant to the general state of the art: U.S. Pat. Nos. 3,328,030; 4,325,548, 5,280,922; 5,290,043; 5,669,833; 5,697,791; 6,220,974; and, 6,475,108.

The following US patents are of interest in that they describe the use of indicia on the kicker's shoe and the ball to guide the user in perfecting the desired kick: U.S. Pat. Nos. 3,348,842; and, 3,370,851.

Lastly, U.S. Pat. No. 2,458,984 describes a stance or positioning device for a sport other than soccer.

While efforts have been made to improve the kicking technique of a football player or a soccer player, to date, none appear to be satisfactory or robust enough for wide general use. In particular, at the present time there do not appear to be any that correctly and properly optimize the position of the striking foot, as it strikes the ball with respect to the plant foot, coupled with proper alignment indicia and adjustment capability to make the device suitable for a wide range of users.

It was in the context of the foregoing prior art that the present invention arose.

SUMMARY OF THE INVENTION

Briefly described, the invention comprises a soccer ball kicking training device which properly aligns the plant foot with respect to the striking foot in such a way that the kicker quickly learns the optimal manner of kicking a soccer ball. When used properly, the player plants his or her plant foot next to a positioning pad preferably having the contour of a shoe or foot. Attached to the pad is a brightly colored triangular arrow pointing in a direction parallel to the long axis of the foot. This gives the kicker the strong suggestion of the proper orientation of the foot with respect to the proper target line. A connecting member is attached near the toe portion of the plant foot positioning pad and at right angles thereto. The distal end of the connecting member is attached to an offset member, also set at 90 degrees, but facing backward, in the direction of the plant foot. Attached to the offset member is a ball supporting pad which preferably includes a shallow indent for receiving the soccer ball. The soccer ball receiving pad is located in such a fashion that the ball is positioned behind the toe of the plant foot but ahead of the heel and across from the instep of the plant foot. The connecting means also includes, and is attached to, a distance adjusting means, preferably formed from, Velcro®, a hook and loop type fastener, so that the distance between the ball and the plant foot can be modified in a range of between 10–20 inches depending upon the age and size of the kicker. The device can be flipped over 180 degrees so that the device can be used by players whose dominant foot might be either the right or left foot or if they choose to learn how to kick with either foot.

The invention may be more fully understood by reference to the following drawings:

DETAILED DESCRIPTION OF THE PREFERRED EMBODIMENT

During the course of this description like numbers will be used to identify like elements according to the different figures that illustrate the invention.

According to the 2001 National Soccer Participation Survey, approximately 19 million Americans participate in some form of organized soccer. Of that, approximately 15 million players are between 6 and 17 years old. Despite the popularity of soccer most players, especially children, kick balls erratically and off target because they are not aware of, or don't comprehend, basic foot positioning principles. Part of the problem is that most players prefer their dominant foot (right or left) and find it is both difficult and unnatural to use their other foot as their striking foot. Additionally, children with learning disabilities, such as dyslexia, have special recognition challenges that are not properly addressed by present teaching aids. In summary, there does not appear to be a simple, cost effective product available to the general public that teaches correct foot positioning.

Kicking a ball is a two-footed process that requires:

a. correct plant and strike foot positioning;

b. correct body shoulder positioning;

c. properly striking the ball.

Most young players do not understand the importance of foot positioning and how it impacts the quality and effectiveness of their balance and striking ability. The present invention 10, illustrated in FIG. 1A, helps young players learn to position their feet as well as how to square up their shoulders and position their bodies for a proper soccer kick.

Figure 1A:
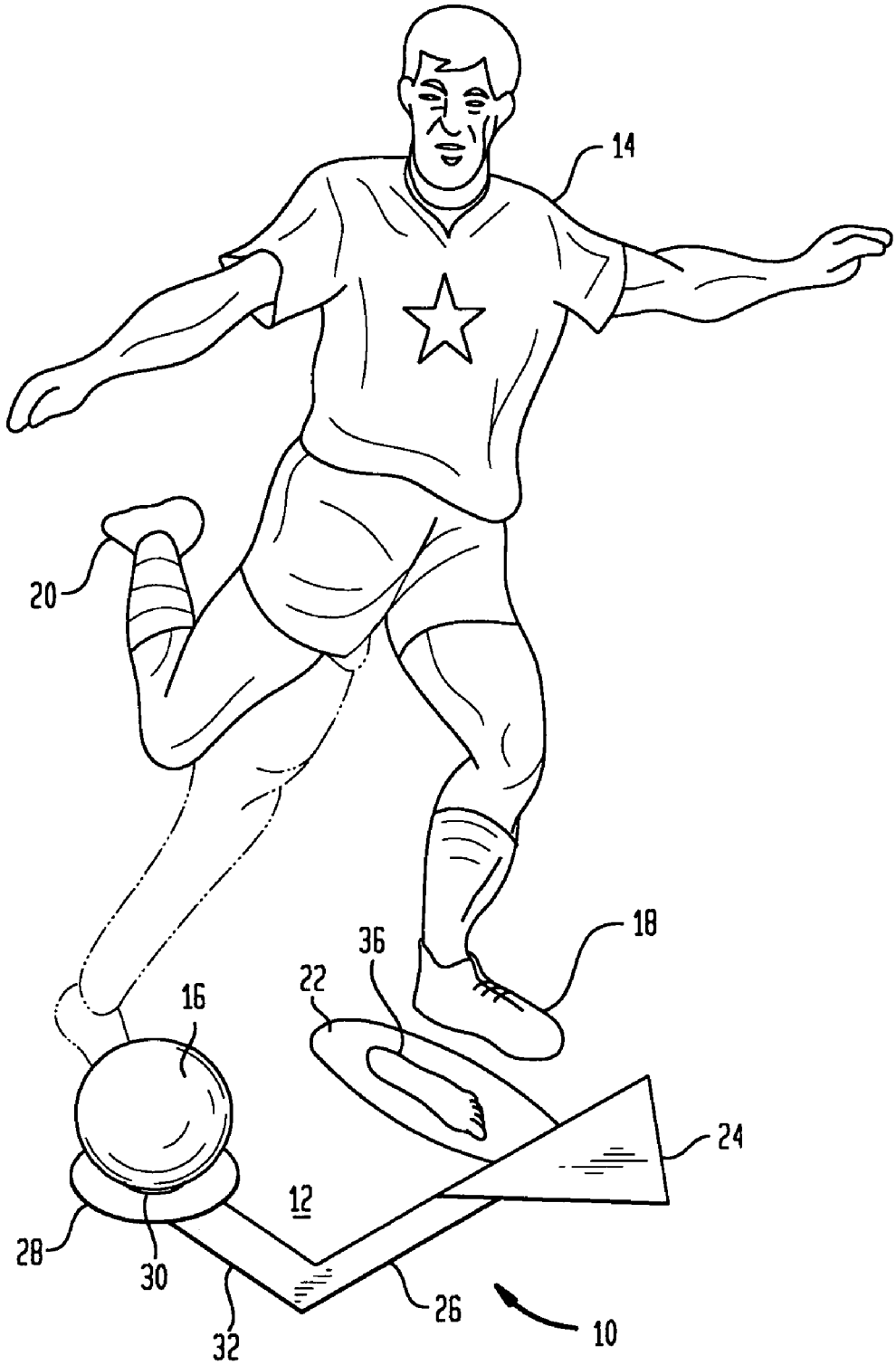
FIG. 1A illustrates how a kicker with a dominant right foot kicks a ball off of the preferred embodiment of the invention.

As shown in FIG. 1A, the invention 10 is placed on the ground 12 so that a soccer player 14 can stand over it. The left or, plant foot, 18 of the player is flat on the ground while the strike foot 20 is shown in position about to kick soccer ball 16. Soccer ball 16 is, in turn, supported in a shallow indent 30 located in the kicking training apparatus 10. The player 14 in FIG. 1A is probably using his dominant foot or, alternatively, may be practicing to kick with his non-dominant foot.

Figure 1B:
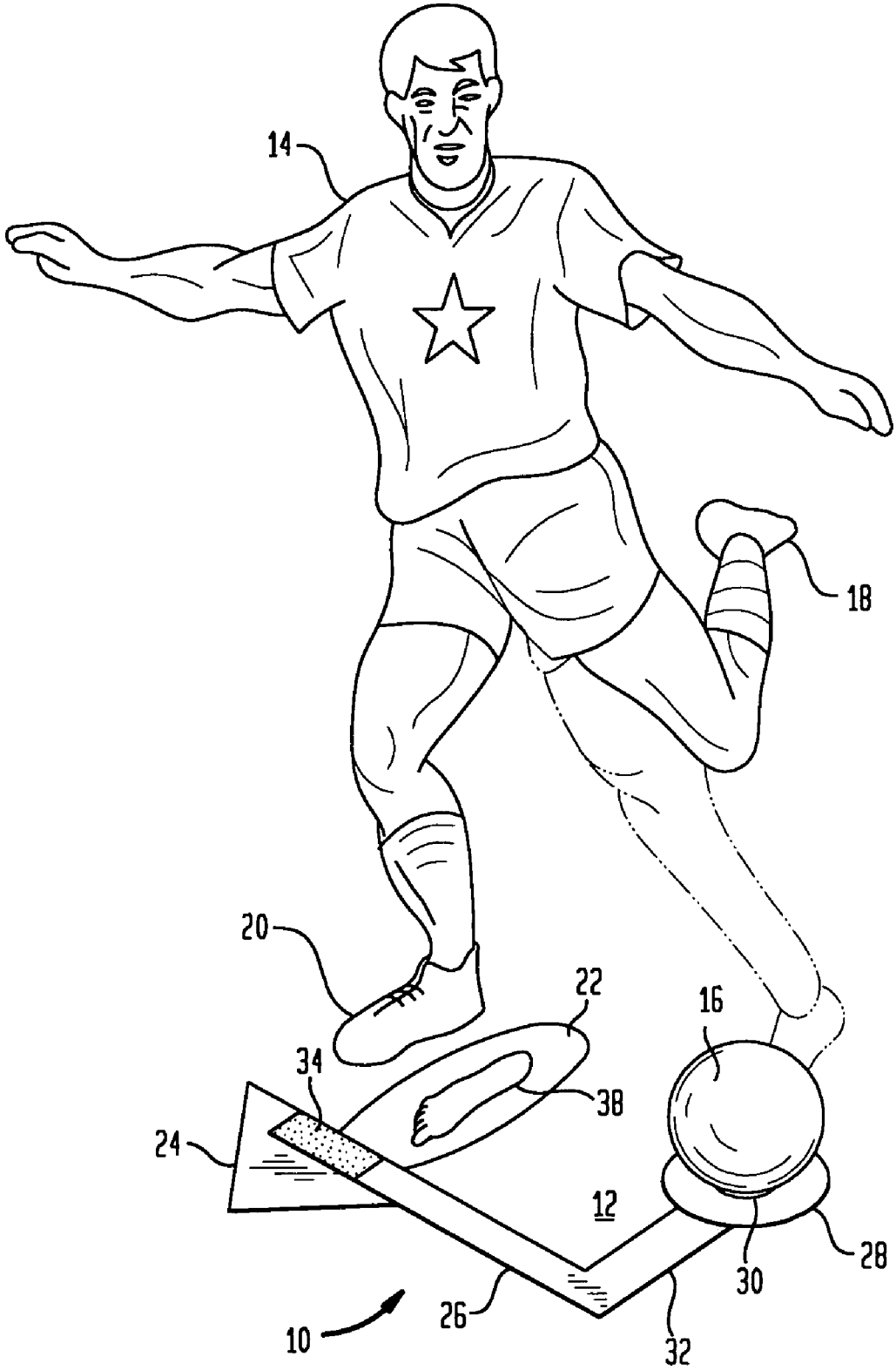
FIG. 1B illustrates the apparatus as flipped over so that it could be used by a player having a dominant left foot.
Figure 2A:
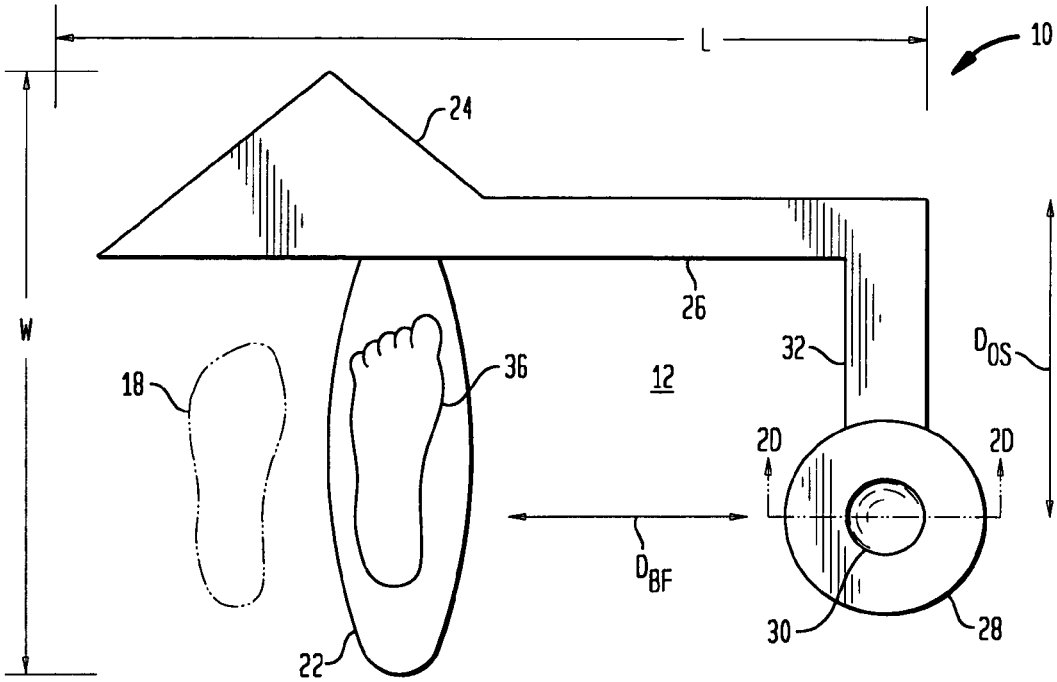
FIG. 2A is a top plan view of the invention.
Figure 2B:
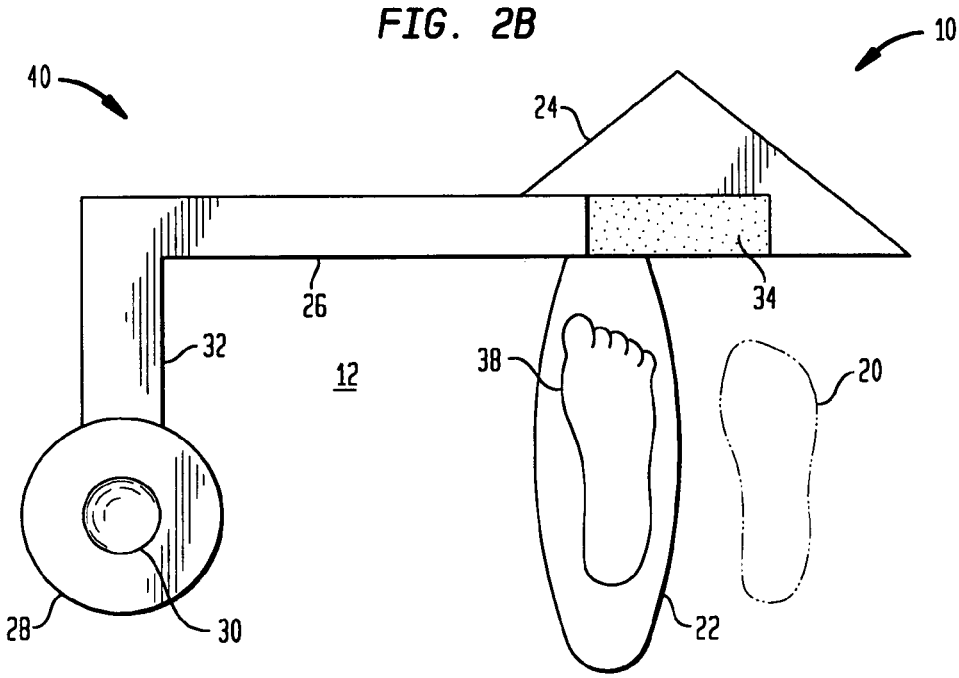
FIG. 2B is a bottom plan view of the invention showing how the invention is used when flipped over.

In FIG. 1B the invention 10 is illustrated in its flipped over mode, as also shown in FIG. 2B so that the player 14 can kick with his left foot 18. In this case the plant foot 20 is on the ground and the striking foot 18 is shown elevated in position to kick soccer ball 16. The player 14 in FIG. 1B probably has a dominant left foot or, alternatively, may be practicing to kick with his non-dominant foot.

The invention 10 may be further understood by reference to FIGS. 2A–2D.

As shown in FIG. 2A, the invention 10 preferably comprises a plant foot positioning pad 22 which is attached, at the toe portion thereof to an adjustable length connecting member 26, which, in turn, is attached to an extension offset member 32 positioned at 90 degrees with respect to adjustable length connecting member 26 and which terminates in a ball positioning pad 28. The ball positioning pad 28 includes an indent 30 for receiving and holding the soccer ball 16 in the manner previously described with regard to FIGS. 1A and 1B. A big red arrow 24 is attached to the structure of the adjustable length connecting member 26 and assists the player in the proper positioning of his or her plant foot. As shown in FIG. 2A, the invention 10 has a width (W), an adjustable length (L), a ball offset distance ($D_{OS}$) and a distance ($D_{BF}$) between the foot positioning pad 22 and the ball support pad 28. According to the preferred embodiment of the invention, those dimensions are preferably as follows:

W=16"

L=10"–20"

$D_{OS}$=8.5"

$D_{BF}$=10"

The "L" is adjustable between 10" and 20" by means of a conventional adjusting means such as, Velcro®, a hook and loop type fastener 34. Other adjustable structures, such as a loop and slide arrangement are known to those of ordinary skill in the art and could also be used to adjust the length L. The invention 10 is preferably molded from a high impact, high density plastic such as polyethylene or polyvinylchloride or other high impact plastics or metals known to those of ordinary skill in the art. A phantom left plant foot 18 is shown adjacent to and parallel to the foot positioning pad 22 and pointing in the direction of the arrow implied by the target line indicator 24. Plant positioning pad 22 includes an outline or indicia 36 suggestive of the left or plant foot 18 of the player 14.

FIG. 2B illustrates the invention 10 flipped over 180 degrees so that it can be used by a player 14 having a dominant left strike foot 18 as seen in FIG. 1B. An outline of the right plant foot 38 is shown on the underside of the foot positioning pad 22. A phantom outline of the plant foot 20 is shown adjacent to and parallel to the outline 38 and pointing in the direction of the arrow 24. A Velcro® hook and loop fastener attachment area 34 is shown at the juncture of the adjustable connecting member 26 and the arrow section 24. The Velcro® hook and loop fastener area in an attachment area 34 preferably comprises a hook-type material on the member 26 and a loop type material on the arrow 24 which may be selectively positioned so that the length L can be adjusted between 10" and 20" as previously described.

Figure 2C:
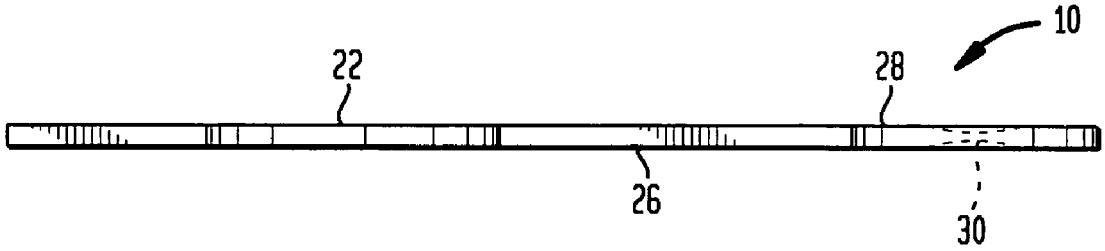
FIG. 2C is a side view of the invention illustrating the indent which receives the soccer ball.

FIG. 2C is a side view of the invention 10. The indent portion 30 for supporting the ball 16 is clearly visible in phantom.

Figure 2D:
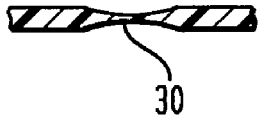
FIG. 2D is a partial cross-sectional view of the indent that receives the soccer ball.

The two-sided indent section 30 is further illustrated in FIG. 2D which comprises a partial cross-section 2D—2D shown in FIG. 2A.

The invention 10 is preferably used in the following manner. Initially, the player 14 lays the invention 10 on the ground with the oversized red arrow 24 aimed at a conventional target such as a goal, wall, or other player, etc. Next, the player 14 positions his or plant foot 18 next to the plastic foot alignment outline 36 on the foot positioning pad 22 as shown in FIG. 1A.

The setup procedure is reversed if the player 14 has a dominant left strike foot 18 as shown in FIG. 1B.

In a third step, the player 14 adjusts the length L by selectively mating the hooks and loops of the Velcro® hook and loop fastener attachment device 34. The length L is preferably in the range of 10"–20", as previously described, and is preferably, approximately the width of the shoulders of the player 14. This is intended to encourage the player 14, regardless of age, to "square" his or her shoulders and body to the target.

The fourth step is for the player 14 to place the ball 16 in the indent 30 on the ball positioning pad 28. It will be noted from FIGS. 2A and 2B, in particular, that the indent 30 and the ball 16 that would sit on it, position the ball behind a line parallel to the toe of the plant foot 18 of the player 14 and approximately off of the instep arch of the plant foot 18. This is optimal for a soccer player 14 or any other individual who kicks a round ball but may not be optimal for a non-round ball such as footballs.

Fifth and lastly, the player 14 kicks the ball either with his right strike foot 20 as shown in FIG. 1A or with his left strike foot 18 as shown in FIG. 1B.

The invention 10 has a variety of advantages and benefits of the prior art.

First, it provides coaches with a visual aid to demonstrate how a soccer ball 16 should be properly kicked.

Secondly, it enables players to practice correct positioning on their own or with a partner.

Third, it provides parents with a tool that they can easily understand and use to teach their children.

Fourth, the product is relatively inexpensive and easily replaced if broken.

Fifth, most importantly, it helps players grasp the concept of a "plant foot" and its correct positioning with respect to the ball 16 being kicked while at the same time encourages the player 14 to "square" his or her shoulders with respect to the adjustment member 26 so that both the player's feet and shoulders are in proper position for kicking a soccer ball 16. After a substantial amount of practice with the invention 10, the invention 10 would be removed and the player will remember, both mentally and with muscle memory, the correct position for his or her feet, shoulders and body.

While the invention has been described with reference to the preferred embodiment thereof it will be appreciated by those of ordinary skill in the art that various modifications can be made to the structure of the invention without departing from the spirit and scope thereof.

The invention claimed is:

1. A soccer ball kicking training apparatus for teaching a kicker how to kick a soccer ball said apparatus comprising:

plant foot positioning means for optimally positioning the plant foot of a kicker;

wherein said plant foot positioning means has a front portion and a rear portion;

ball positioning means for positioning and supporting said ball at an optimum striking location with respect to said plant foot positioning means;

offset means having a first end and a second end, wherein said first end is attached to and extending upwardly from said ball supporting means;

connecting means having first and second ends, wherein said first end is attached to said plant foot positioning means and said second end is attached to said second end of said offset means, wherein said connecting means is adjustably positioned between said plant foot positioning means and said second end of said offset means so that the lateral distance $D_{BF}$ between said plant foot positioning means and said ball positioning means can be modified selectively according to the kicking characteristics of a kicker, and wherein the effective length L of said connecting means can be adjusted between 10 to 20 inches;

offset means attached to said connecting means;

wherein said offset means is sufficiently long as to position said ball positioning means behind the front portion of said plant foot positioning means.

2. The apparatus of claim 1 wherein said offset means is about 8.5 inches long.

3. The apparatus of claim 2 wherein said ball positioning means includes an indent for receiving said soccer ball.

4. The apparatus of claim 3 wherein said apparatus may be flipped over and used by kickers having a different dominant striking foot.

5. The apparatus of claim 4 further comprising:

aiming means attached to said plant foot positioning means to aim the plant foot at a target.

6. The apparatus of claim 5 wherein said aiming means comprises an arrow pointing in a direction substantially parallel to the long dimension of said kicker's plant foot.

7. A soccer ball kicking training apparatus for teaching a kicker how to kick a soccer ball, said apparatus comprising:

plant foot positioning means for optimally positioning the plant foot of a kicker;

wherein said plant foot positioning means has a front portion and a rear portion;

ball positioning means for positioning and supporting said ball at an optimum striking location with respect to said plant foot positioning means;

offset means having a first end and a second end, wherein said first end is attached to and extending upwardly from said ball supporting means;

connecting means having first and second ends, wherein said first end is attached to said plant foot positioning means and said second end is attached to said second end of said offset means, wherein said connecting means is adjustably positioned between said plant foot positioning means and said second end of said offset means so that the lateral distance $D_{BF}$ between said plant foot positioning means and said ball positioning means can be modified selectively according to the kicking characteristics of a kicker, and wherein the effective length L of said connecting means can be adjusted between 10 to 20 inches;

wherein said offset means is sufficiently long as to position said ball positioning means behind the front portion of said plant foot positioning means; and an aiming means attached to said plant foot positioning means for aiming a plant foot at a target.

* * * * *